US009988916B2

(12) United States Patent
Winn et al.

(10) Patent No.: US 9,988,916 B2
(45) Date of Patent: Jun. 5, 2018

(54) COOLING STRUCTURE FOR STATIONARY BLADE

(71) Applicant: General Electric Company

(72) Inventors: Aaron Gregory Winn, Piedmont, SC (US); George Andrew Gergely, Simpsonville, SC (US); Mary Virginia Holloway, Simpsonville, SC (US); Paul Kendall Smith, Simpsonville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 286 days.

(21) Appl. No.: 14/801,412

(22) Filed: Jul. 16, 2015

(65) Prior Publication Data

US 2017/0016339 A1 Jan. 19, 2017

(51) Int. Cl.
*F01D 9/04* (2006.01)
*F01D 25/12* (2006.01)
(Continued)

(52) U.S. Cl.
CPC ..... *F01D 9/041* (2013.01); *F01D 5/187* (2013.01); *F01D 9/02* (2013.01); *F01D 25/12* (2013.01);
(Continued)

(58) Field of Classification Search
CPC . F01D 25/12; F01D 5/187; F01D 9/02; F01D 9/041; F01D 9/04; F01D 5/186;
(Continued)

(56) References Cited

U.S. PATENT DOCUMENTS 4,017,213 A 4/1977 Przirembel
5,197,852 A 3/1993 Walker et al.
(Continued)

FOREIGN PATENT DOCUMENTS

EP 2 610 436 A2 7/2013
WO 2013/188869 A1 12/2013
WO 2015/053846 A2 4/2015

OTHER PUBLICATIONS

Extended European Search Report and Opinion issued in connection with corresponding EP Application No. 16179541.4 dated Dec. 20, 2016.

*Primary Examiner* — Logan Kraft
*Assistant Examiner* — Peter T Hrubiec
(74) *Attorney, Agent, or Firm* — Ernest G. Cusick; Hoffman Warnick LLC

(57) ABSTRACT

Embodiments of the present disclosure provide a cooling structure for a stationary blade, including: an endwall coupled to a radial end of an airfoil; a chamber positioned within the endwall and radially displaced from a radially outer end of the trailing edge of the airfoil, wherein the chamber includes a pair of opposing chamber walls, one of the pair of opposing chamber walls being positioned proximal to the pressure side surface of the airfoil and the other of the pair of opposing chamber walls being positioned proximal to the suction side surface and the trailing edge of the airfoil, and wherein the cooling fluid in the chamber is in thermal communication with least a portion of the endwall positioned proximal to the pressure side surface and the trailing edge of the airfoil; and a plurality of thermally conductive fixtures positioned within the chamber.

17 Claims, 6 Drawing Sheets

(51) Int. Cl.
*F01D 9/02* (2006.01)
*F01D 5/18* (2006.01)

(52) U.S. Cl.
CPC .... *F05D 2220/30* (2013.01); *F05D 2240/122* (2013.01); *F05D 2240/128* (2013.01); *F05D 2240/81* (2013.01); *F05D 2260/2214* (2013.01)

(58) Field of Classification Search
CPC ..... F05D 2220/30; F05D 2240/122; F05D 2240/128; F05D 2240/81; F05D 2250/71; F05D 2260/2214
See application file for complete search history.

(56) References Cited

U.S. PATENT DOCUMENTS

| | | | | |
|---|---|---|---|---|
| 5,344,283 | A | 9/1994 | Magowan et al. | |
| 5,413,458 | A * | 5/1995 | Calderbank ..... | F01D 5/187 415/115 |
| 7,097,424 | B2 | 8/2006 | Cunha et al. | |
| 7,621,719 | B2 | 11/2009 | Lutjen et al. | |
| 7,625,172 | B2 | 12/2009 | Walz et al. | |
| 8,206,114 | B2 | 6/2012 | Spangler et al. | |
| 8,353,669 | B2 * | 1/2013 | Chon ..... | F01D 5/187 416/193 A |
| 8,356,978 | B2 | 1/2013 | Beattie et al. | |
| 2013/0251508 | A1 | 9/2013 | Tardif et al. | |
| 2014/0000285 | A1 | 1/2014 | Bergman et al. | |

* cited by examiner

COOLING STRUCTURE FOR STATIONARY BLADE

BACKGROUND OF THE INVENTION

The disclosure relates generally to stationary blades, and more particularly, to a cooling structure for a stationary blade.

Stationary blades are used in turbine applications to direct hot gas flows to moving blades to generate power. In steam and gas turbine applications, the stationary blades are referred to as nozzles, and are mounted to an exterior structure such as a casing and/or an internal seal structure by endwalls. Each endwall is joined to a corresponding end of an airfoil of the stationary blade. Stationary blades can also include passages or other features for circulating cooling fluids which absorb heat from operative components of the turbomachine.

In order to operate in extreme temperature settings, the airfoil and endwalls need to be cooled. For example, in some settings, a cooling fluid is pulled from the wheel space and directed to internal endwalls of the stationary blade for cooling. In contrast, in many gas turbine applications, later stage nozzles may be fed cooling fluid, e.g., air, extracted from a compressor of the gas turbine. Outer diameter endwalls may receive the cooling fluid directly, while inner diameter endwalls may receive the cooling fluid after it is routed through the airfoil from the outer diameter. In addition to the effectiveness of cooling, the structure of a stationary blade and its components can affect other factors such as manufacturability, ease of inspection, and the durability of a turbomachine.

BRIEF DESCRIPTION OF THE INVENTION

A first aspect of the present disclosure provides a cooling structure for a stationary blade, including: an endwall coupled to a radial end of an airfoil relative to a rotor axis of a turbomachine, the airfoil including a pressure side surface, a suction side surface, a leading edge, and a trailing edge; a chamber positioned within the endwall and radially displaced from the radial end of the trailing edge of the airfoil, the chamber receiving a cooling fluid from a cooling fluid source, wherein the chamber includes a pair of opposing chamber walls, one of the pair of opposing chamber walls being positioned proximal to the pressure side surface of the airfoil and the other of the pair of opposing chamber walls being positioned proximal to the suction side surface and the trailing edge of the airfoil, and wherein the cooling fluid in the chamber is in thermal communication with least a portion of the endwall positioned proximal to the pressure side surface and the trailing edge of the airfoil; and a plurality of thermally conductive fixtures positioned within the chamber and distributed substantially uniformly throughout the chamber.

A second aspect of the present disclosure provides a cooling structure for a stationary blade, including: an endwall coupled to a radial end of an airfoil relative to a rotor axis of a turbomachine, the airfoil including a pressure side surface, a suction side surface, a leading edge, and a trailing edge; a chamber positioned within the endwall and radially displaced from the radial end of the trailing edge of the airfoil, the chamber receiving a cooling fluid from a cooling fluid source, wherein the chamber includes a pair of opposing chamber walls, one of the pair of opposing chamber walls being positioned proximal to the pressure side surface of the airfoil and the other of the pair of opposing chamber walls being positioned proximal the suction side surface of the airfoil and substantially radially displaced from the trailing edge of the airfoil, the cooling fluid in the chamber is in thermal communication with at least a portion of the endwall positioned proximal to the pressure side surface and the trailing edge of the airfoil, and wherein the chamber further includes a cavity radially displaced from a high mach region of the stationary blade adjacent to the trailing edge and the pressure side surface of the airfoil; and at least one thermally conductive fixture positioned within the cavity.

A third aspect of the present disclosure provides a cooling structure for a stationary blade, including: an endwall coupled to a radial end of an airfoil relative to a rotor axis of a turbomachine, the airfoil including a pressure side surface, a suction side surface, a leading edge, and a trailing edge; a chamber positioned within the endwall and radially displaced from the radial end of the trailing edge of the airfoil, the chamber receiving a cooling fluid from a cooling fluid source, wherein the chamber includes a pair of opposing chamber walls, one of the pair of opposing chamber walls being positioned proximal to the pressure side surface of the airfoil and the other of the pair of opposing chamber walls being positioned proximal to the suction side surface of the airfoil and substantially radially displaced from the trailing edge of the airfoil, the cooling fluid in the chamber is in thermal communication with at least a portion of the endwall positioned proximal to the pressure side surface and the trailing edge of the airfoil, and wherein the chamber further includes a cavity radially displaced from a high mach region of the stationary blade adjacent to the trailing edge and the pressure side surface of the airfoil; and a plurality of thermally conductive fixtures positioned within the chamber and distributed substantially uniformly throughout the chamber.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

Figure 1:
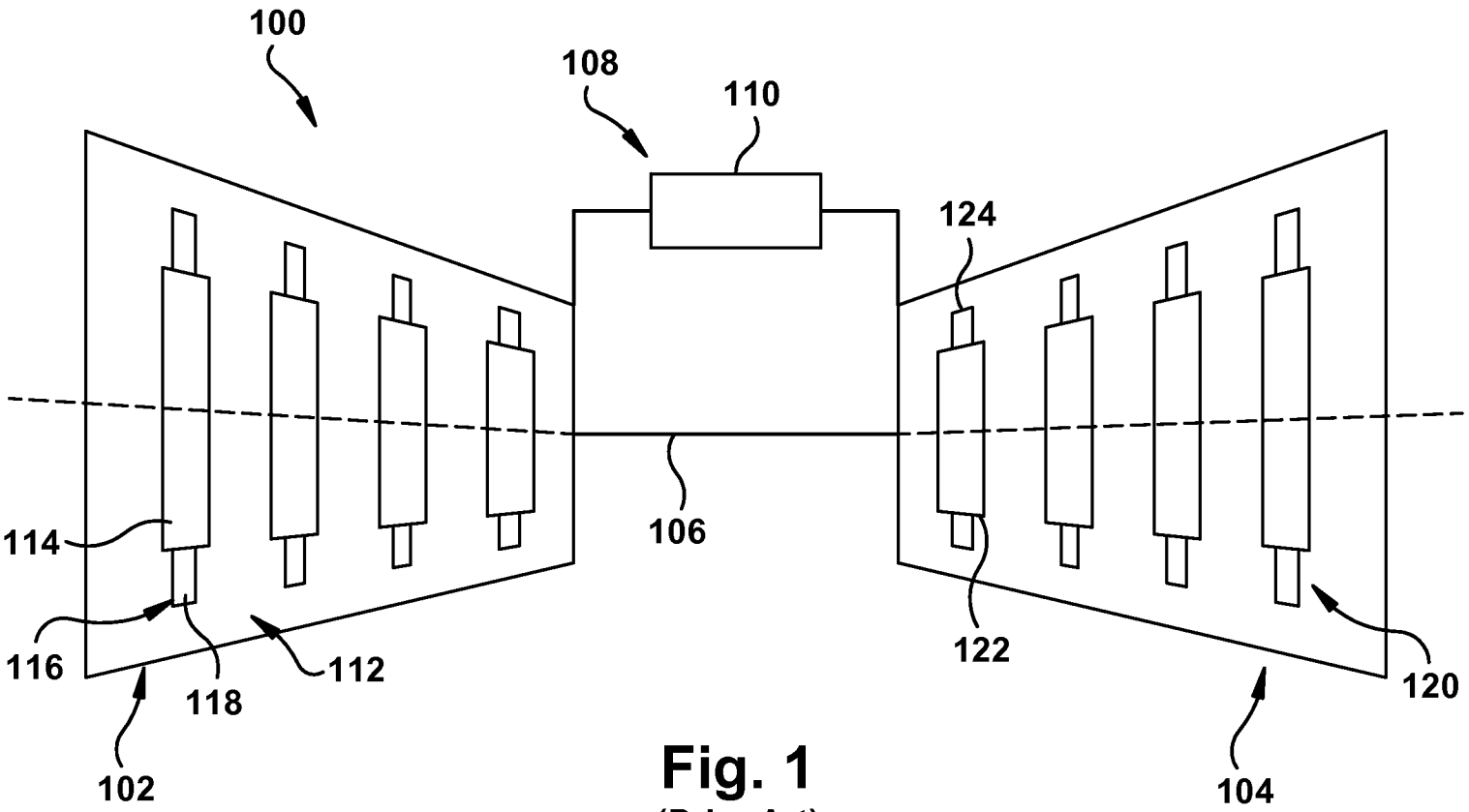
Fig. 1 (Prior Art)
FIG. 1 shows a schematic view of a conventional turbomachine.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

Embodiments of the present disclosure relate generally to cooling structures for stationary blades. In a stationary blade, a portion of the endwall adjacent to the pressure side surface of an airfoil, located upstream of a nozzle throat, can be subject to high velocity air in the corresponding flow path. These upstream areas of the endwall and stationary blade can be difficult to cool due to their proximity to the perimeter of the endwall and their location above the mounting instruments of the endwall, e.g., because the stationary blade may not include impingement cooling circuits. To mitigate temperature increases during operation, embodiments of the present disclosure can provide a cooling chamber in the endwall which provides greater access for film hole drilling throughout this region. Nozzle trailing edges can also be subject to relatively high thermal stresses. Embodiments of the present disclosure can also reduce stresses in the trailing edge of the nozzle airfoil with an internal chamber configuration which provides convective cooling underneath the thinnest portion of the airfoil trailing edge where it intersects the endwall.

In particular, embodiments of the present disclosure can provide an endwall coupled to a radial end of an airfoil of a stationary blade, with the airfoil including a pressure side surface, a suction side surface, a leading edge, and a trailing edge. The endwall can include a chamber, radially displaced from the radial end of the airfoil, which receives a cooling fluid from a dedicated source. The chamber can include a pair of opposing chamber walls. At least one chamber wall can be positioned proximal to the pressure side surface of the airfoil, with the opposing chamber wall positioned proximal to the suction side surface and the trailing edge of the airfoil. Cooling fluids passing through the chamber can be in thermal communication with at least a portion of the endwall which is proximal to the pressure side surface and trailing edge of the airfoil. The cooling structure can also include additional structures for providing thermal communication. Thermally conductive fixtures can be substantially uniformly distributed throughout the chamber. In addition or alternatively, the chamber can include a cavity radially displaced from a high mach region adjacent to the trailing edge and pressure side surface of the airfoil.

Spatially relative terms, such as "inner," "outer," "beneath," "below," "lower," "above," "upper," "inlet," "outlet," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Embodiments of the disclosure provide a cooling structure for a stationary blade of a turbomachine. In one embodiment, the cooling structure may include a chamber within the endwall and radially displaced from a radial end of the trailing edge of the airfoil. Cooling fluids in the chamber can be in thermal communication with a portion of the endwall positioned proximal to the pressure side surface and trailing edge of the airfoil. The chamber can optionally include a plurality of thermally conductive fixtures distributed substantially uniformly throughout the chamber and/or a cavity radially displaced from a high mach region of the stationary blade. FIG. 1 shows a conventional turbomachine 100 that includes a compressor portion 102 operatively coupled to a turbine portion 104 through a common compressor/turbine shaft 106. Compressor portion 102 is also fluidically connected to turbine portion 104 through a combustor assembly 108. Combustor assembly 108 includes one or more combustors 110. Combustors 110 may be mounted to turbomachine 100 in a wide range of configurations including, but not limited to, being arranged in a can-annular array. Compressor portion 102 includes a plurality of compressor rotor wheels 112. Rotor wheels 112 include a first stage compressor rotor wheel 114 having a plurality of first stage compressor rotor blades 116 each having an associated airfoil portion 118. Similarly, turbine portion 104 includes a plurality of turbine rotor wheels 120 including a first stage turbine wheel 122 having a plurality of first stage turbine rotor blades 124. In accordance with an exemplary embodiment, a stationary blade 200 (FIG. 3) with a cooling structure according to embodiments of the present disclosure can provide cooling to endwalls and airfoils located in, e.g., turbine section 104. It will be understood, however, that embodiments of stationary blade 200 and the various cooling structures described herein may be positioned in other components or areas of turbomachine 100.

Figure 2:
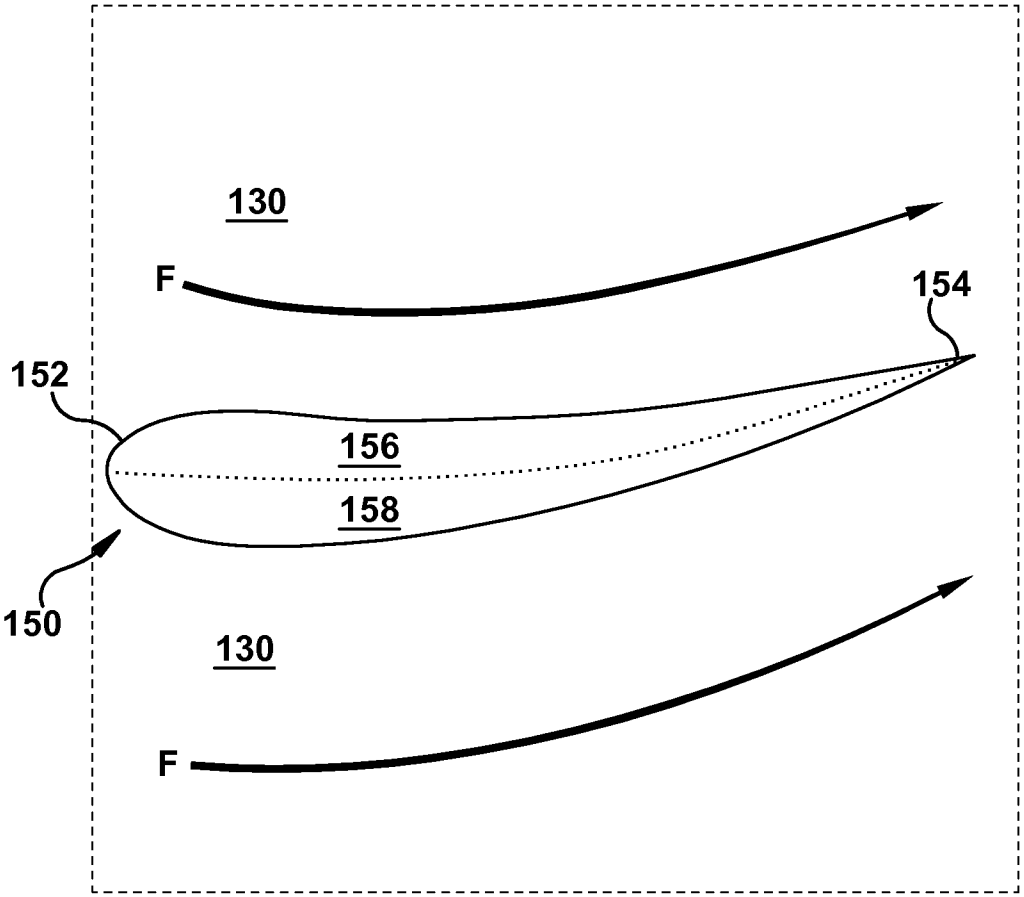
FIG. 2 is a cross-sectional view of an airfoil of a stationary blade positioned within a flow path of operative fluid according to embodiments of the present disclosure.

Turning to FIG. 2, a cross-section of an airfoil 150 having a flow path 130 for operating fluids therein is shown. Airfoil 150 can be part of stationary blade 200 (FIG. 3), and can further include the components and/or points of reference described herein. The locations on airfoil 150 identified in FIG. 2 and discussed herein are provided as examples and not intended to limit possible locations and/or geometries for airfoils 150 according to embodiments of the present disclosure. The placement, arrangement, and orientation of various sub-components can change based on intended use and the type of power generation system in which cooling structures according to the present disclosure are used. The shape, curvatures, lengths, and/or other geometrical features of airfoil 150 can also vary based on the application of a particular turbomachine 100 (FIG. 1). Airfoil 150 can be positioned between successive turbine rotor blades 124 (FIG. 1) of a power generation system such as turbomachine 100.

Airfoil 150 can be positioned downstream of one turbine rotor blade 124 (FIG. 1) and upstream of another, subsequent turbine rotor blade 124 (FIG. 1) in a flow path for an operative fluid. Fluids can flow across airfoil 150, e.g., along path(s) F, while traveling from one turbine rotor blade 124 to another. A leading edge 152 of airfoil 150 can be positioned at an initial point of contact between operative fluid in flow path 130 and airfoil 150. A trailing edge 154, by contrast, can be positioned at the opposing side of airfoil 150. In addition, airfoil 150 can include a pressure side surface 156 and/or suction side surface 158 distinguished by a transverse line which substantially bisects leading edge 152 and extends to the apex of trailing edge 154. Pressure side surface 156 and suction side surface 158 can also be distinguished from each other based on whether fluids in flow path 130 exert positive or negative resultant pressures against airfoil 150. A portion of pressure side surface 156 positioned proximal to trailing edge 154 can be known as and referred to as a "high mach region" of airfoil 150. A high mach region generally refers to a location operative fluids flow at a higher speed the flow of operative fluids at or near other surfaces of airfoil 150 based on, e.g., the geometry of pressure side surface 156 and suction side surface 158 of airfoil 150.

Figure 3:
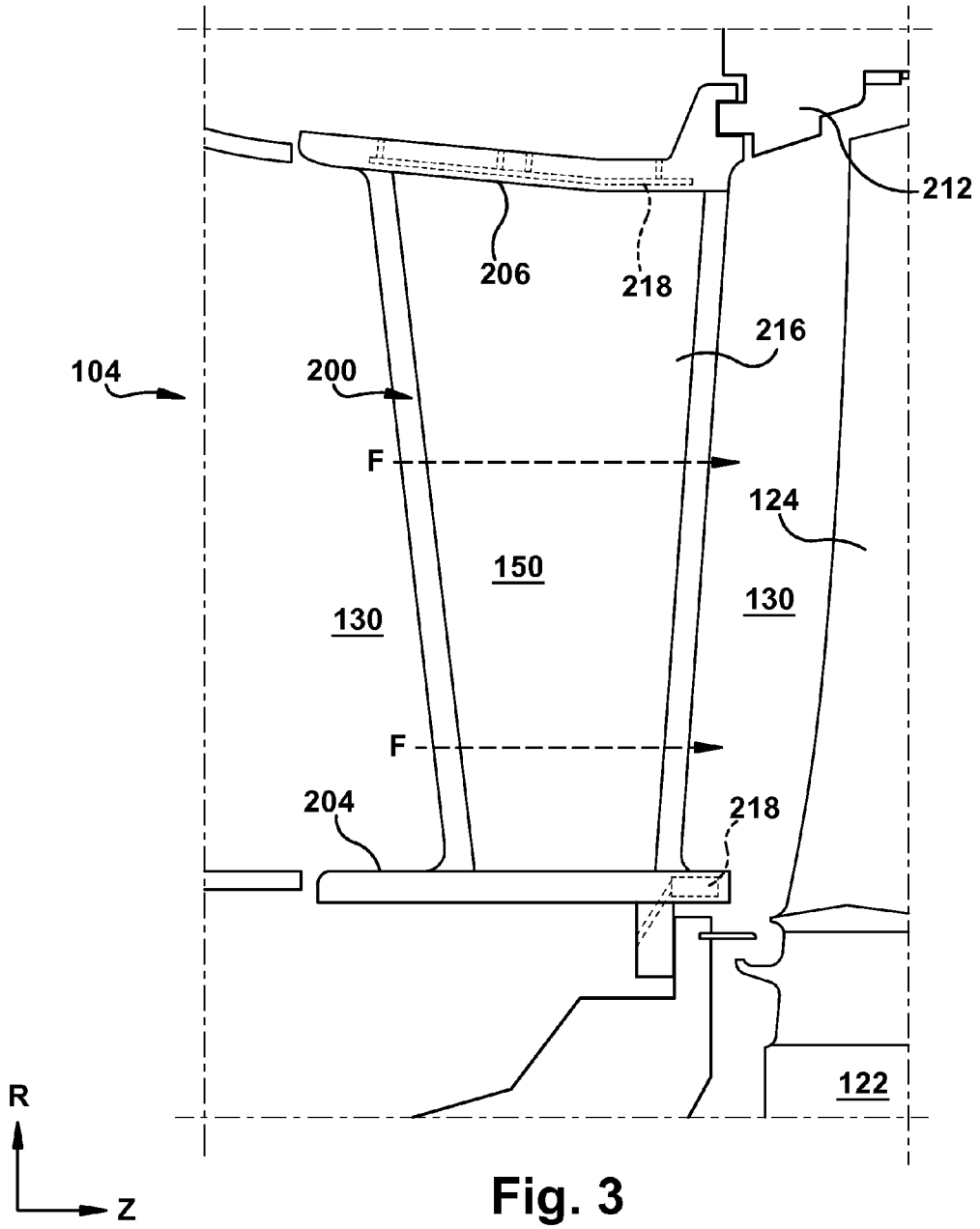
FIG. 3 is a cross-sectional view of a stationary blade between two rotor blades in a turbine section of a turbomachine.

Turning to FIG. 3, a cross section of flow path 130 past a stationary blade 200 positioned within turbine portion 104 is shown. An operative fluid (e.g., hot combustion gasses, steam, etc.) can flow (e.g., along flow lines F) through flow path 130, where it can flow to further turbine rotor blades 124 as directed by the position and contours of stationary blade 200. Turbine portion 104 is shown extending along a rotor axis Z of turbine wheel 122 (e.g., coaxial with shaft 106 (FIG. 1)), and with a radial axis R extending outwardly and perpendicularly therefrom. Stationary blade 200 can include airfoil 150 oriented substantially along (i.e., extending in a direction parallel with) radial axis R. Although one stationary blade 200 is shown in the cross-sectional view of FIG. 2, it is understood that multiple turbine rotor blades 124 and stationary blades 200 can extend radially from turbine wheel 122, e.g., extending laterally into and/or out of the plane of the page. An airfoil 150 of stationary blade 200 can include an inner endwall 204 coupled to an inner radial end of airfoil 150, and an outer endwall 206 coupled to an outer, opposing radial end of airfoil 150. Embodiments of the present disclosure can provide a cooling structure for singlet, first stage nozzles of turbomachine 100 (FIG. 1). A "singlet" turbine nozzle refers to a type of stationary blade 200 in which only one airfoil 150 extends between inner and outer endwalls 204, 206. A "first stage" turbine nozzle refers to a nozzle included in turbine section 104 (FIG. 1) immediately downstream of combustor 110 (FIG. 1). Singlet turbine nozzles may differ from later-stage turbine nozzles based on one or more structural differences, e.g., the configuration by which each nozzle is mechanically supported within turbomachine 100. For example, later-stage turbine nozzles may include cantilevered stationary blades, whereas singlet turbine nozzles may be simply supported. In a simply supported structure, stationary blade 200 can be directly supported at the opposing surfaces of contact between airfoil 150 and inner and outer endwalls 204, 206.

Inner endwall 204 can be positioned adjacent to turbine wheel 122, while outer endwall 206 can be positioned adjacent to a turbine shroud 212. During operation, the hot combustion gases travelling along flow lines F can transfer heat to airfoil 150 and endwall(s) 204, 206 e.g., by operative fluids contacting airfoil 150 and endwall(s) 204, 206 of stationary blade 200. In some circumstances, airfoil 150 of stationary blade 200 may include an interior cooling circuit (not shown) therein. Specifically, some types of airfoils 150 can include an interior cavity or other cooling circuit for transmitting cooling fluids radially through airfoil 150, e.g., through an airfoil body 216 extending between endwalls 204, 206. In these types of systems, cooling fluids flowing within airfoil body 216 can absorb heat from the operative fluid in flow path 130 via the thermally conductive material composition of airfoil 150. However, in other embodiments (e.g., first stage singlet turbine nozzles), the cross-section of airfoil 150 may not include any interior cooling circuits therein. For stationary blades 200 without cooling circuits within airfoil 150, cooling can instead be provided with cooling circuits within inner and outer endwalls, 204, 206, without impingement cooling circuits within airfoil 150 and/or fluid communication between cooling circuits in airfoil 150 and endwalls 204, 206. Each endwall 204, 206 can include a chamber 218 therein for circulating cooling fluid(s) within stationary blade 200. The cooling fluids within chamber 218 of inner endwall 204 or outer endwall 206 can absorb heat from operating fluids in flow path 130 through the thermally conductive material composition of each endwall 204, 206 and airfoil 150. In embodiments of the present disclosure, heat transferred to airfoil 150 from operative fluids in flow path 130 can be transmitted to chamber(s) 218 of inner and outer endwalls 204, 206 through the material composition of stationary blade 200. Stationary blade 200, including airfoil 150 and endwalls 204, 206, can therefore be composed of thermally conductive metals such as industrial steels, superalloys, etc.

Figure 4:
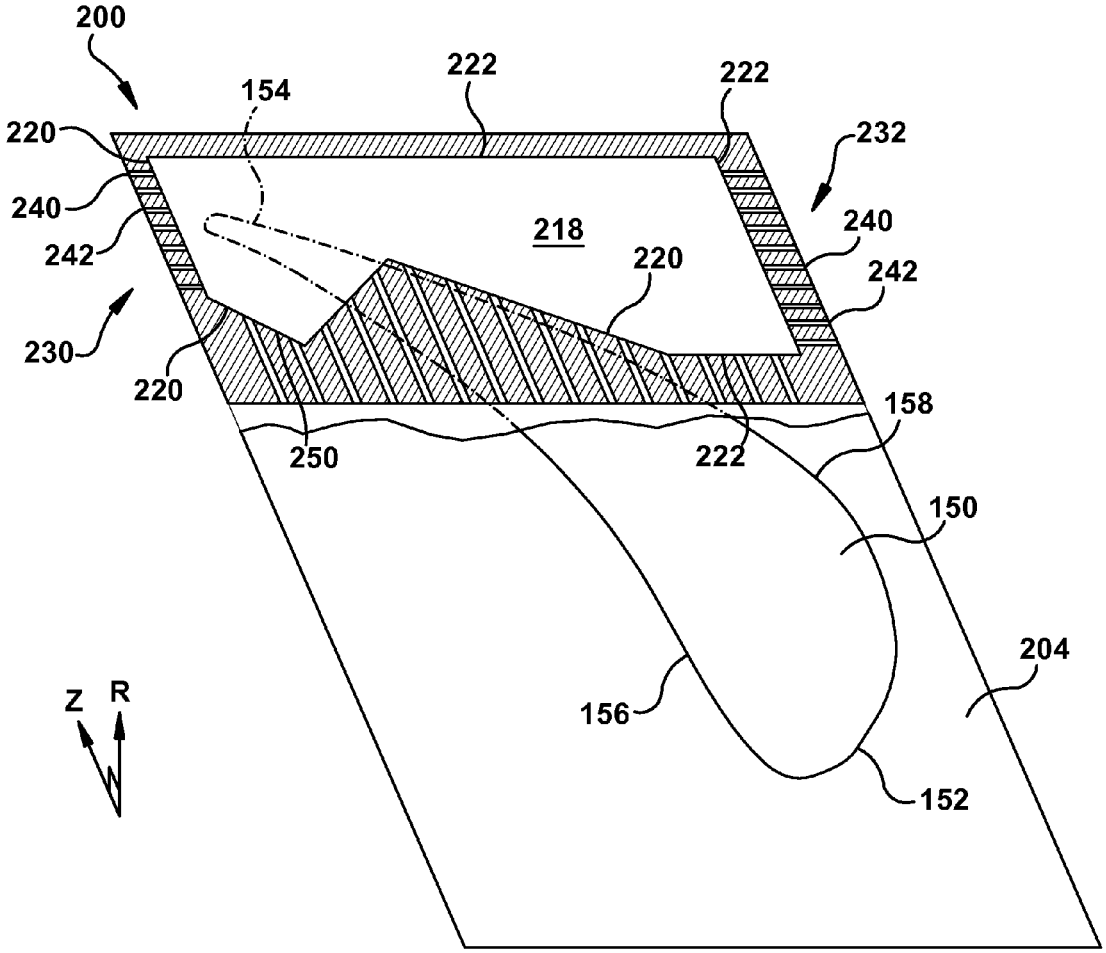
FIG. 4 is a perspective cut away view of a cooling structure for a stationary blade according to embodiments of the present disclosure.

Turning to FIG. 4, a partial, cut-away perspective view of one endwall 204 with chamber 218 therein is shown. Although one airfoil 150 is shown coupled to endwall 204 in FIG. 4 (i.e., in a singlet, simply supported turbine nozzle configuration) as an example, it is understood that any desired number of airfoils 150 may be coupled to endwall 204 to suit varying turbomachine designs and applications. Cooling structures for stationary blade 200 in a singlet, simply supported turbine nozzle of a turbomachine can provide cooling to trailing edge 154 of airfoil 150 and other aft portions of endwall 204 where other approaches, e.g., impingement cooling circuits, are not available or practical.

Endwall 204 can include one chamber 218 extending radially beneath airfoil 150 between two locations within endwall 204. As shown in FIG. 4, chamber 218 can be primarily disposed proximal to suction side surface 158 of airfoil 150, and can extend circumferentially below trailing edge 154 of airfoil 150, e.g., underneath a region of high fluid acceleration proximal to pressure side surface 156. Chamber 218 can be positioned between the rotor axis of turbomachine 100 (FIG. 1) and trailing edge 154 of airfoil 150, such that airfoil 150 and chamber 218 are structurally distinct from each other. Embodiments of chamber 218 can provide greater access for film hole drilling along or near pressure side surface 156 of endwall(s) 204, 206 (FIG. 3 only) and can also provide structures for reducing stress in trailing edge 154 of airfoil 150. Although inner endwall 204 is shown by example in FIG. 4, it is understood that each of the embodiments and features of the present disclosure can also be implemented within outer endwall 206. Endwall(s) 204, 206 can optionally include additional chambers, other than chamber 218, to provide other forms of cooling to stationary blade 200.

Chamber 218 can include multiple chamber walls 220, 222 defining a perimeter of chamber 218 within endwall 204. Chamber 218 can be displaced from an inner radial end of airfoil 150 (e.g., in a different circumferential plane from the entirety of airfoil 150), with at least one chamber wall 220 positioned proximal to pressure side surface 156 of airfoil 150. At least one opposing chamber wall 222 can be positioned proximal to suction side surface 158 and trailing edge 154. The term "proximal," as used herein, can indicate that one element is separated from the proximal element by, e.g., only a single intervening element or a group of thermally conductive intervening elements. In embodiments of the present disclosure, opposing chamber wall(s) 222 being proximal to suction side surface 158 and trailing edge 154 of airfoil 150 indicates that these elements are structurally separated from each other only by the body of inner or outer endwall 204, 206. The position of chamber walls 220, 222 can provide thermal communication between cooling fluids in chamber 218 and at least a portion of endwall 204 positioned proximal to trailing edge 154 and pressure side surface 156 of airfoil 150, e.g., to allow heat transfer from these portions of airfoil 150 to cooling fluids in chamber 218 through endwall 204.

To circulate cooling fluids into and out of chamber 218, endwall 204 of stationary blade 200 can include a first plurality of passages 230 and a second plurality of passages 232 therein. First plurality of passages 230 and second plurality of passages 232 can each extend through chamber wall 220 or opposing chamber wall 222, such that each passage in the first and second pluralities of passages 230, 232 is in fluid communication with chamber 218. Embodiments of the present disclosure can provide a non-linear flow of cooling fluids throughout chamber 218 during operation. That is, first and second plurality of passages 230, 232 can each include at least one inlet 240 and at least one outlet 242, such that cooling fluid enters and exits chamber 218 non-exclusively through first plurality of passages 230 and/or second plurality of passages 232. Cooling fluids in chamber 218 can enter and exit chamber 218 through passages in only one plurality of passages 230, 232. In an embodiment, an amount of cooling fluid can flow only through portions of chamber 218 positioned proximal to trailing edge 154, suction side surface 158, or pressure side surface 156 after entering chamber 218 through inlet 240 and exiting chamber 218 through outlet 242. Including inlets 240 and outlets 242 in each plurality of passages 240, 242, can also allow cooling fluids from a cooling source (not shown) in fluid communication with chamber 218 to have a higher concentration in portions of chamber 218 where additional cooling of airfoil 150 and endwall 204 is desired. For example, a larger portion of cooling fluid can enter and exit chamber 218 close to pressure side surface 156 and trailing edge 154 of airfoil 150, e.g., while a smaller portion of cooling fluid can be routed into and out of chamber 218 at other locations. In any event, chamber 218 can receive cooling fluids from sources other than an impingement cooling circuit. Inner or outer endwall 204, 206 can make up part of a stationary blade 200 without any impingement cooling circuits included therein, or at least without impingement cooling circuits extending through trailing edge 154 of airfoil 150 and in fluid communication with chamber 218.

To increase thermal communication between cooling fluids in chamber 218 and portions of endwall 204 and/or airfoil 150 located proximal to high temperature, high-speed operating fluids, chamber 218 can also include a cavity 250 therein. Cavity 250 can be positioned within endwall(s) 204, 206 (FIG. 3 only) below at least a high mach region of stationary blade 200 located adjacent to, e.g., trailing edge 154 and pressure side surface 156 of airfoil 150. Cavity 250 can be provided as a section, pocket, indentation, or otherwise distinct subsection of chamber 218 dimensioned to collect and/or internally circulate cooling fluid(s) therein, to provide increased thermal communication between cooling fluids in cavity 250 of chamber 218 and cooling fluids in the high mach region adjacent airfoil 150 and radially displaced from cavity 250. Cavity 250 can provide additional cooling in areas of chamber 218 in thermal communication with high temperature regions of endwall(s) 204, 206, in addition to serving as a pressure sink location to create a circumferential draw of cooling fluids through chamber 218.

Figure 5:
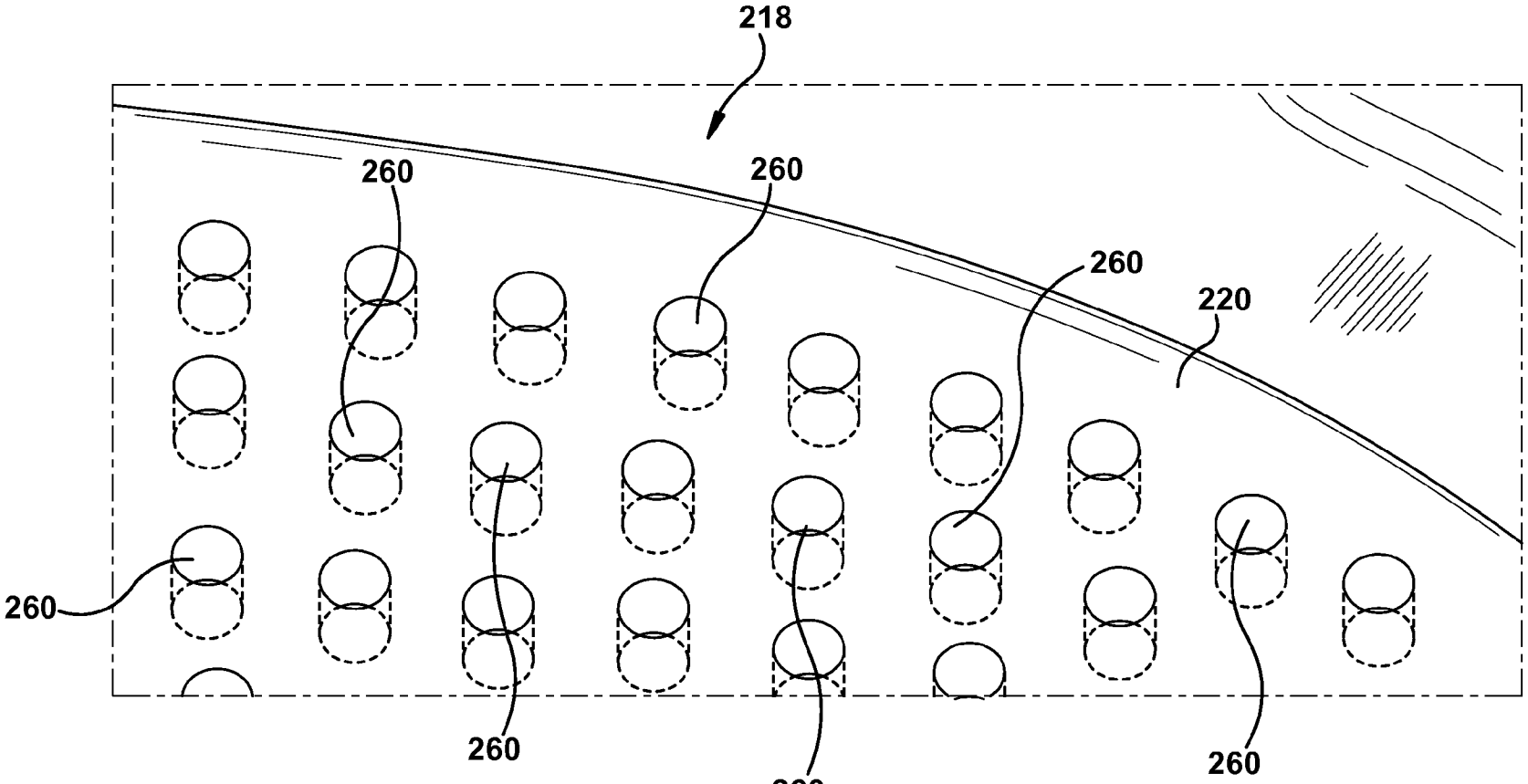
FIG. 5 is a perspective partial cut away view of a chamber within an endwall according to embodiments of the present disclosure.

Referring to FIG. 5, embodiments of the present disclosure can include a thermally conductive fixture ("fixture") 260, such as a pedestal, within chamber(s) 218 for transferring heat from stationary blade 200 to cooling fluids within chamber(s) 218. More specifically, each fixture 260 can transmit heat from endwall 204 to cooling fluids therein by increasing the contact area between cooling fluids passing through chamber(s) 218 and the material composition of endwall(s) 204, 206. Chamber 218 being in the form of a single continuous chamber extending from a region substantially radially aligned suction side surface 158 and trailing edge 154, to pressure side surface 156 of endwall(s) 204, 206 can increase the total coverage of fixtures 260, to provide additional back-side cooling to high mach regions positioned adjacent to endwall(s) 204, 206. Fixtures 260 can be provided as any conceivable fixture for increasing the contact area between cooling fluids and thermally conductive surfaces, and as examples can be in the form of pedestals, dimples, protrusions, pins, walls, and/or other fixtures of other shapes and sizes. Furthermore, fixtures 260 can take a variety of shapes, including those with cylindrical geometries, substantially pyramidal geometries, irregular geometries with four or more surfaces, etc. In any event, one or more fixtures 260 can be positioned within chamber 218 between opposing chamber walls, 220, 222 (FIG. 4), inlets 240, and/or outlets 242 included within each to be in contact with cooling fluids flowing through chamber 218.

Figure 6:
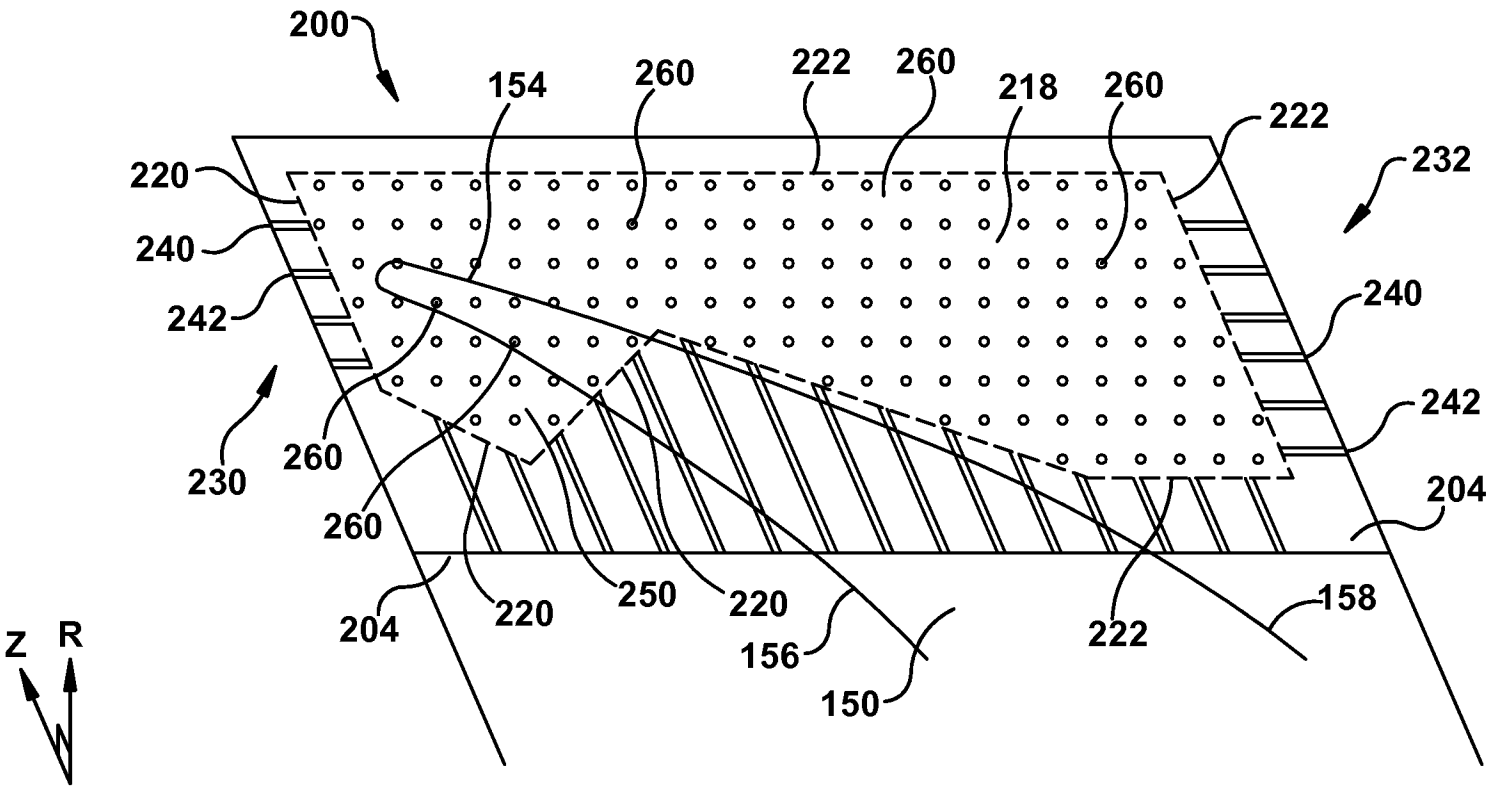
FIG. 6 provides a perspective partial cut away view of a cooling structure for a stationary blade according to embodiments of the present disclosure.

Turning to FIG. 6, a partial perspective cut away view of endwall 204 with chamber 218 and fixtures 260 therein is shown. Embodiments of the present disclosure can provide fixtures 260 within chamber 218 in a substantially uniform distribution. That is, each fixture 260 in chamber 218 can be separated from each adjacent fixture 260 in chamber 218 by substantially the same separation distance. It is understood that some separation distances between adjacent fixtures 260 may vary from other separation distances by minor or insubstantial amounts due to, e.g., manufacturing variability, even where fixtures 260 are provided in a substantially uniform distribution. A "substantially uniform" distribution includes any distribution which is indistinguishable from a uniform distribution during operation, i.e., provides the same amount of thermal communication or heat transfer within a margin of error of at most approximately 5.0%. Each fixture 260 can thus be one of a plurality of thermally conductive fixtures positioned within chamber 218 and distributed substantially uniformly throughout chamber 218, thereby providing a continuous bank of fixtures 260 throughout endwall(s) 204, 206. The spacing between adjacent fixtures 260 can vary between types of inner and outer endwalls 204, 206. In an example embodiment, the separation distance between each adjacent fixture 260 can be between, e.g., approximately one millimeter (mm) and approximately twenty mm in a substantially uniform distribution throughout chamber 218.

Although a plurality of fixtures 260 are provided within chamber 218 and distributed substantially uniformly throughout chamber 218 in FIG. 6, it is also understood that the present disclosure also provides for alternative embodiments. For example, fixtures 260 can be provided within chamber 218 in a different circumferential plane from the structure of airfoil 150 at trailing edge 154. More specifically, at least one fixture 260 can be radially aligned with a portion of endwall 204 located, e.g., at most 5.0 mm from pressure side surface 156 or suction side surface 158 on trailing edge 154 of airfoil 150. In addition or alternatively, embodiments of chamber 218 with cavity 250 therein can include at least one fixture 260 positioned within cavity 250. One or more fixtures 260 being substantially radially aligned with trailing edge 154 and/or within cavity 250 can provide for increased thermal communication between cooling fluids and endwall 204 in areas where more cooling is desired, e.g., a high mach region adjacent to trailing edge 154 and pressure side surface 156 of airfoil 150. A substantially uniform distribution of fixtures 260 throughout chamber 218 can further improve heat transfer between cooling fluids in chamber 218 and endwall 204 proximal to pressure side surface 156 and suction side surface 158, e.g., by reducing the thermal gradient across endwall(s) 204, 206 through convective cooling through fluids cooling fluids within chamber 218. Inlets 240 and outlets 242 being included in each plurality of passages 230, 232 can allow more cooling fluids to enter cavity 250. For example, a larger portion of cooling fluid can be routed to inlets 240 in first plurality of passages 230 in fluid communication with cavity 250, compared to the amount of cooling fluid routed to other inlets 240 in first or second plurality of passages 230, 232 in fluid communication with other areas in chamber 218.

Embodiments of the present disclosure can provide several technical and commercial advantages, some of which are discussed by example herein. For example, the position of elements described herein (e.g., the position of cavity 250 and/or distribution of fixtures 260) can provide for efficient use of cooling fluid flow in endwall 204 and cooling fluid reservoirs in fluid communication with chamber 218. In addition, embodiments of the present disclosure can provide an increased total amount of cooling to stationary blade 200, particularly in areas susceptible to high temperatures such as a high mach region adjacent to airfoil 150. The position of chamber 218 and components therein can improve the mechanical durability and stability of stationary blades 200, thereby providing increased manufacturability and reduced condition-based maintenance costs for deployed and serviced machines. Improved thermal communication between operative fluids and cooling fluids in chamber 218 can also reduce the total amount of nozzle cooling flow needed during operation, and can reduce the design complexity needed to form inner and outer endwalls 204, 206 out of cast, ferrous metal substances such as aluminum, copper, iron, lead, and/or combinations of these materials in substances such as steel. The presence of inlets 240 and outlets 242 in first and second plurality of passages 230, 232 can provide a non-linear flow of cooling fluids throughout chamber 218 during operation, and in particular can allow for a greater concentration of cooling fluids to be routed to portions of chamber 218 proximal to trailing edge 154 and pressure side surface 156 of airfoil 150. A greater concentration of cooling fluids in these areas (e.g., within cavity 250 of chamber 218) can allow for dynamic tuning of cooling fluid flow through chamber 218.

The apparatus and method of the present disclosure is not limited to any one particular gas turbine, combustion engine, power generation system or other system, and may be used with other power generation systems and/or systems (e.g., combined cycle, simple cycle, nuclear reactor, etc.). Additionally, the apparatus of the present invention may be used with other systems not described herein that may benefit from the increased operational range, efficiency, durability and reliability of the apparatus described herein. In addition, the various injection systems can be used together, on a single nozzle, or on/with different nozzles in different portions of a single power generation system. Any number of different embodiments can be added or used together where desired, and the embodiments described herein by way of example are not intended to be mutually exclusive of one another.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A cooling structure for a stationary blade, comprising:

an endwall coupled to a radial end of an airfoil relative to a rotor axis of a turbomachine, the airfoil including a pressure side surface, a suction side surface, a leading edge, and a trailing edge;

a chamber positioned within the endwall directly radially beneath the trailing edge of the airfoil and radially displaced from the radial end of the trailing edge of the airfoil, the chamber receiving a cooling fluid from a cooling fluid source, wherein the chamber includes:

a pair of opposing chamber walls, one of the pair of opposing chamber walls being positioned proximal to the pressure side surface of the airfoil and the other of the pair of opposing chamber walls being positioned proximal to the suction side surface and the trailing edge of the airfoil;

a cavity defining a pressure sink region, the cavity radially displaced from a high mach region of the stationary blade adjacent to the trailing edge and the pressure side surface of the airfoil, wherein the cooling fluid in the chamber is in thermal communication with least a portion of the endwall positioned proximal to the pressure side surface and the trailing edge of the airfoil;

a first plurality of passages positioned within the endwall, the first plurality of passages extending through one of the pair of opposing chamber walls positioned proximal to the trailing edge of the airfoil and in fluid communication with the chamber;

a second plurality of passages positioned within the endwall, extending through the other of the pair of opposing chamber walls, and in fluid communication with the chamber, wherein a portion of the cooling fluid in the chamber enters and exits the chamber through passages of only the first or second plurality of passages; and a plurality of thermally conductive fixtures positioned within the chamber and distributed substantially uniformly throughout the chamber.

2. The cooling structure of claim 1, wherein the plurality of thermally conductive fixtures includes a pedestal radially displaced from the trailing edge of the airfoil.

3. The cooling structure of claim 1, wherein each of the first plurality of passages and the second plurality of passages further includes a respective cooling fluid inlet and a respective cooling fluid outlet.

4. The cooling structure of claim 1, wherein at least one of the plurality of thermally conductive fixtures is positioned within the cavity.

5. The cooling structure of claim 1, wherein the stationary blade comprises a singlet, first stage nozzle of a turbomachine.

6. The cooling structure of claim 1, wherein the airfoil is free of impingement cooling circuits therein.

7. A cooling structure for a stationary blade, comprising:

an endwall coupled to a radial end of an airfoil relative to a rotor axis of a turbomachine, the airfoil including a pressure side surface, a suction side surface, a leading edge, and a trailing edge;

a chamber positioned within the endwall directly radially beneath the trailing edge of the airfoil and radially displaced from the radial end of the trailing edge of the airfoil, the chamber receiving a cooling fluid from a cooling fluid source, wherein the chamber includes:

a pair of opposing chamber walls, one of the pair of opposing chamber walls being positioned proximal to the pressure side surface of the airfoil and the other of the pair of opposing chamber walls being positioned proximal the suction side surface of the airfoil and substantially radially displaced from the trailing edge of the airfoil, the cooling fluid in the chamber is in thermal communication with at least a portion of the endwall positioned proximal to the pressure side surface and the trailing edge of the airfoil;

a first plurality of passages positioned within the endwall, extending through one of the pair of opposing chamber walls positioned proximal to the trailing edge of the airfoil, and in fluid communication with the chamber, wherein the chamber further includes a cavity defining a pressure sink region, the cavity radially displaced from a high mach region of the stationary blade adjacent to the trailing edge and the pressure side surface of the airfoil;

a second plurality of passages positioned within the endwall, extending through the other of the pair of opposing chamber walls, and in fluid communication with the chamber, wherein portion of the cooling fluid in the chamber enters and exits the chamber through passages of on the first or second plurality of passages; and at least one thermally conductive fixture positioned within the cavity.

8. The cooling structure of claim 7, further comprising a second thermally conductive fixture positioned within the chamber and radially displaced from the trailing edge of the airfoil.

9. The cooling structure of claim 7, wherein each of the first plurality of passages and the second plurality of passages further includes a respective cooling fluid inlet and a respective cooling fluid outlet.

10. The cooling structure of claim 7, wherein the at least one thermally conductive fixture comprises one of a plurality of thermally conductive fixtures positioned within the chamber and distributed substantially uniformly throughout the chamber.

11. The cooling structure of claim 7, wherein the stationary blade comprises a singlet, first stage nozzle of a turbomachine.

12. The cooling structure of claim 7, wherein the airfoil is free of impingement cooling circuits therein.

13. A cooling structure for a stationary blade, comprising:

an endwall coupled to a radial end of an airfoil relative to a rotor axis of a turbomachine, the airfoil including a pressure side surface, a suction side surface, a leading edge, and a trailing edge;

a chamber positioned within the endwall directly radially beneath the trailing edge of the airfoil and radially displaced from the radial end of the trailing edge of the airfoil, the chamber receiving a cooling fluid from a cooling fluid source, wherein the chamber includes:

a pair of opposing chamber walls, one of the pair of opposing chamber walls being positioned proximal to the pressure side surface of the airfoil and the other of the pair of opposing chamber walls being positioned proximal to the suction side surface of the airfoil and substantially radially displaced from the trailing edge of the airfoil, the cooling fluid in the chamber is in thermal communication with at least a portion of the endwall positioned proximal to the pressure side surface and the trailing edge of the airfoil;

a first plurality of passages positioned within the endwall, extending through one of the pair of opposing chamber walls positioned proximal to the trailing edge of the airfoil, and in fluid communication with the chamber;

a second plurality of passages positioned within the endwall, extending through the other of the pair of opposing chamber walls, and in fluid communication with the chamber, wherein a portion of the cooling fluid in the chamber enters and exits the chamber through passages of only the first or second plurality of passages; and wherein the chamber further includes a cavity defining a pressure sink region, the cavity radially displaced from a high mach region of the stationary blade adjacent to the trailing edge and the pressure side surface of the airfoil; and a plurality of thermally conductive fixtures positioned within the chamber and distributed substantially uniformly throughout the chamber.

14. The cooling structure of claim 13, wherein each of the first plurality of passages and the second plurality of passages further includes a respective cooling fluid inlet and a respective cooling fluid outlet.

15. The cooling structure of claim 13, wherein the stationary blade comprises a singlet, first stage nozzle of a turbomachine.

16. The cooling structure of claim 13, wherein the airfoil is free of impingement cooling circuits therein.

17. The cooling structure of claim 13, wherein the plurality of thermally conductive fixtures includes a pedestal radially displaced from the trailing edge of the airfoil.

* * * * *